US012708207B1

(12) United States Patent
Hopkins

(10) Patent No.: US 12,708,207 B1
(45) Date of Patent: Aug. 18, 2026

(54) ANTI-TIP INFLATABLE CHAIR

(71) Applicant: Ideal, LLC, Asheville, NC (US)

(72) Inventor: William Lucas Hopkins, Asheville, NC (US)

(73) Assignee: Ideal LLC, Asheville, NC (US)

( * ) Notice: Subject to any disclaimer, the term of this patent is extended or adjusted under 35 U.S.C. 154(b) by 0 days.

(21) Appl. No.: 19/278,216

(22) Filed: Jul. 23, 2025

(51) Int. Cl.
*A47C 3/16* (2006.01)
*A47C 1/14* (2006.01)
*A47C 4/54* (2006.01)

(52) U.S. Cl.
CPC ..... *A47C 3/16* (2013.01); *A47C 1/143* (2013.01); *A47C 4/54* (2013.01)

(58) Field of Classification Search
CPC ..... A47C 1/143; A47C 4/54; A47C 3/16
USPC ..... 297/380
See application file for complete search history.

(56) References Cited

U.S. PATENT DOCUMENTS 2,480,196 A * 8/1949 Poyer ..... A47C 4/54 5/617
4,945,587 A * 8/1990 Ferro ..... A47C 4/54 5/419

FOREIGN PATENT DOCUMENTS

GB 598247 A * 2/1948 ..... A47C 4/54

* cited by examiner

*Primary Examiner* — Milton Nelson, Jr.
(74) *Attorney, Agent, or Firm* — Craig R. Miles; CR MILES P.C.

(57) ABSTRACT

Inflatable anti-tip articles and methods of making and using embodiments of the inflatable anti-tip articles, wherein the inflatable anti-tip article includes an inflatable body having a first face opposite a second face joined at a body periphery defining an interior chamber, wherein upon inflation the inflated article includes one or more bend angles in the first face and/or the second face which define a rotation axis along the points of contact of the inflatable body with a support surface, wherein an anti-tip device disposed along or adjacent the rotation axis opposes rotation of the inflatable body about the rotation axis between the points of contact of the inflatable body with the support surface.

10 Claims, 15 Drawing Sheets

ANTI-TIP INFLATABLE CHAIR

I. FIELD OF THE INVENTION

Inflatable anti-tip articles and methods of making and using embodiments of the inflatable anti-tip articles, wherein the inflatable anti-tip article includes an inflatable body having a first face opposite a second face joined at a body periphery defining an interior chamber, wherein upon inflation the inflated article includes one or more bend angles in the first face and/or the second face which define a rotation axis along the points of contact of the inflatable body with a support surface, wherein an anti-tip device disposed along or adjacent the rotation axis opposes rotation of the inflatable body about the rotation axis between the points of contact of the inflatable body with the support surface.

II. BACKGROUND OF THE INVENTION

Conventional inflatable articles include angles or bends in the face(s) to configure the inflatable articles as chairs, seats, lounges, benches, couches. Inflatable articles may not be affixed to a rigid framework, therefore, the bends in an inflatable article in contact with a support surface may define a rotation axis about which the inflatable article may rotate or tip during use. Tipping in which the inflatable articles falls backward during use can lead to injury of the user or damage to property.

There would be a substantial advantage in provision of inflatable article(s) which include an anti-tip device disposed along or adjacent the rotation axis between the points of contact of the inflatable body with the support surface that opposes rotation of the inflatable body about the rotation axis to reduce the risk of injury or damage to property.

III. SUMMARY OF THE INVENTION

Accordingly, a broad object of embodiments of the invention can include an inflatable article including one more of: an inflatable body having a first face opposite a second face extending to a body periphery, wherein upon inflation the inflatable body has a bend disposed across the first face or the second face to the body periphery, wherein the bend defines a rotation axis along the points of contact of the inflatable body with a support surface; and an anti-tip device coupled to the inflatable body proximate the rotation axis of said inflatable body, wherein the anti-tip device has an anti-tip arm extending outward of the rotation axis to shift the distance of a moment-arm backward from the center of mass of said inflatable body, wherein the anti-tip device opposes rotation of the inflatable body about the rotation axis between the points of contact of said inflatable body with said support surface.

Another broad object of the invention can include a method of making an inflatable article including one or more of: producing an inflatable body having a first face opposite a second face extending to a body periphery, wherein upon inflation the inflatable body has a bend disposed across the first face or the second face to the body periphery, wherein the bend disposed across said second face defines a rotation axis along the points of contact of the inflatable body and a support surface; and coupling an anti-tip device to the inflatable body proximate the rotation axis of said inflatable body, wherein the anti-tip device has an anti-tip arm extending outward of the rotation axis to shift the distance of a moment-arm backward from the center of mass of the inflatable article, wherein the anti-tip device opposes rotation of the inflatable body about the rotation axis between the points of contact of the inflatable body and the support surface.

Naturally, further objects of the invention are disclosed throughout other areas of the specification, drawings, photographs, and claims.

IV. BRIEF DESCRIPTION OF THE DRAWINGS

Figure 14A:
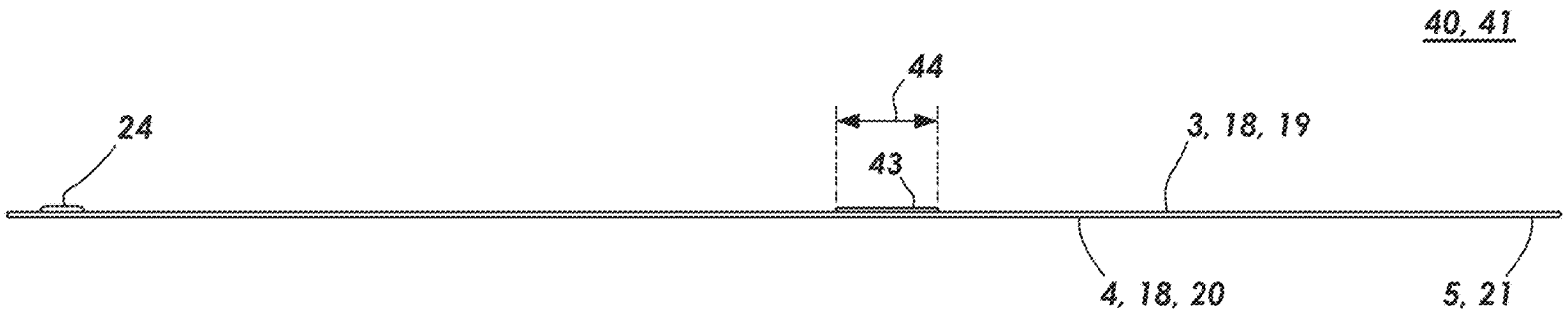
FIG. 14A is a first side elevation view of an inflatable body having a first face opposite a second face joined at a body periphery in an uninflated condition.
Figure 14B:
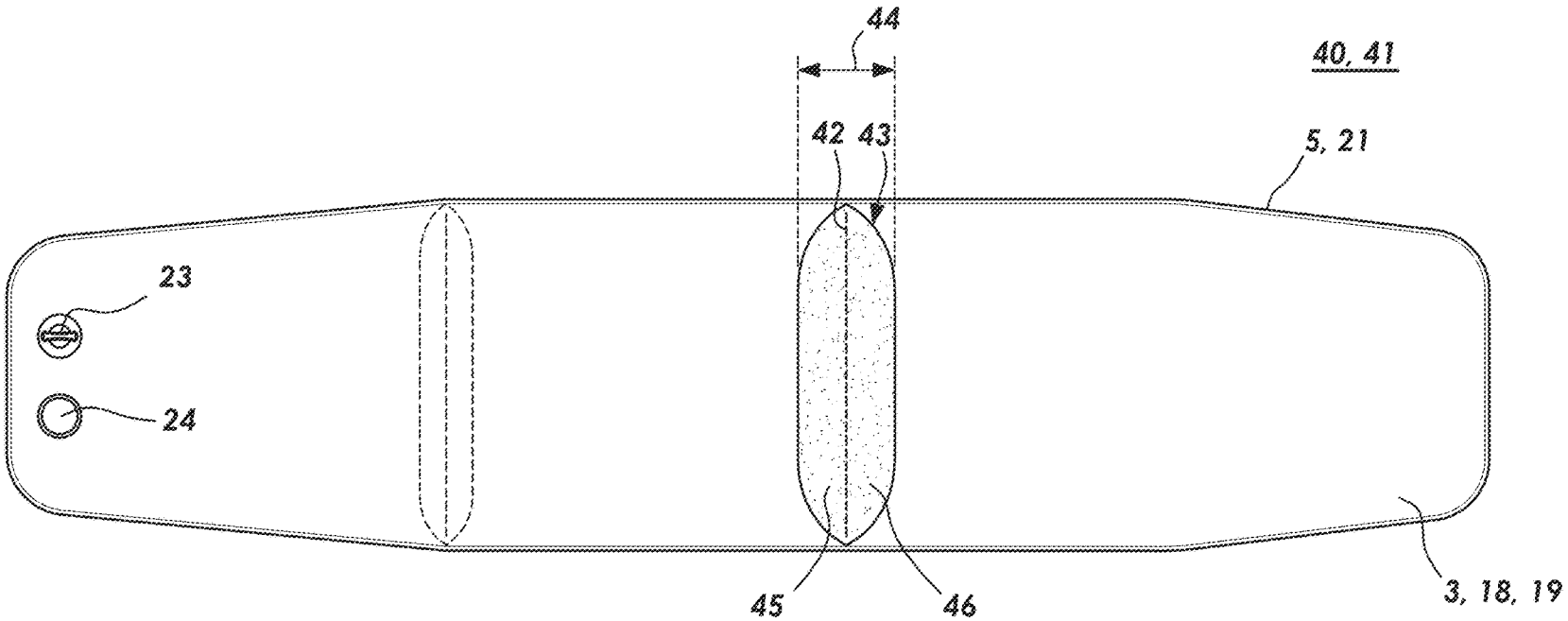
FIG. 14B is a top plan view of the inflatable body having a first face disposed in a substantially flat condition having a first adhesive area generally bisected by a first bend angle axis into a first adhesive area adjacent a second adhesive area.
Figure 14C:
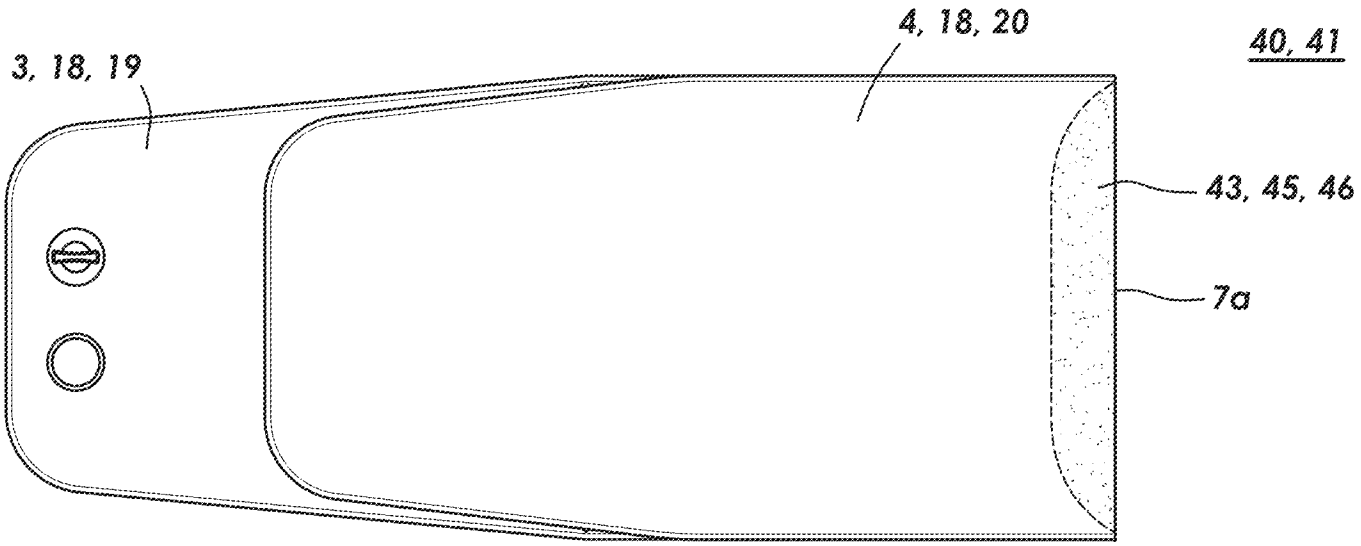
FIG. 14C is a top plan view of the inflatable body having a first face disposed in a substantially flat condition folded on the first bend angle axis to adhere the first adhesive area the second adhesive area.
Figure 14D:
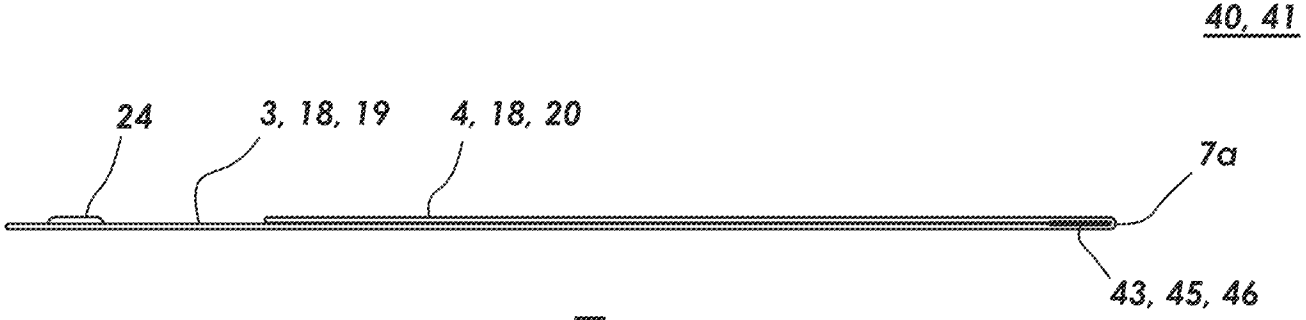
FIG. 14D is a first side elevation view of the inflatable body having a first face disposed in a substantially flat condition folded on the first bend angle axis to adhere the first adhesive area the second adhesive area.
Figure 14E:
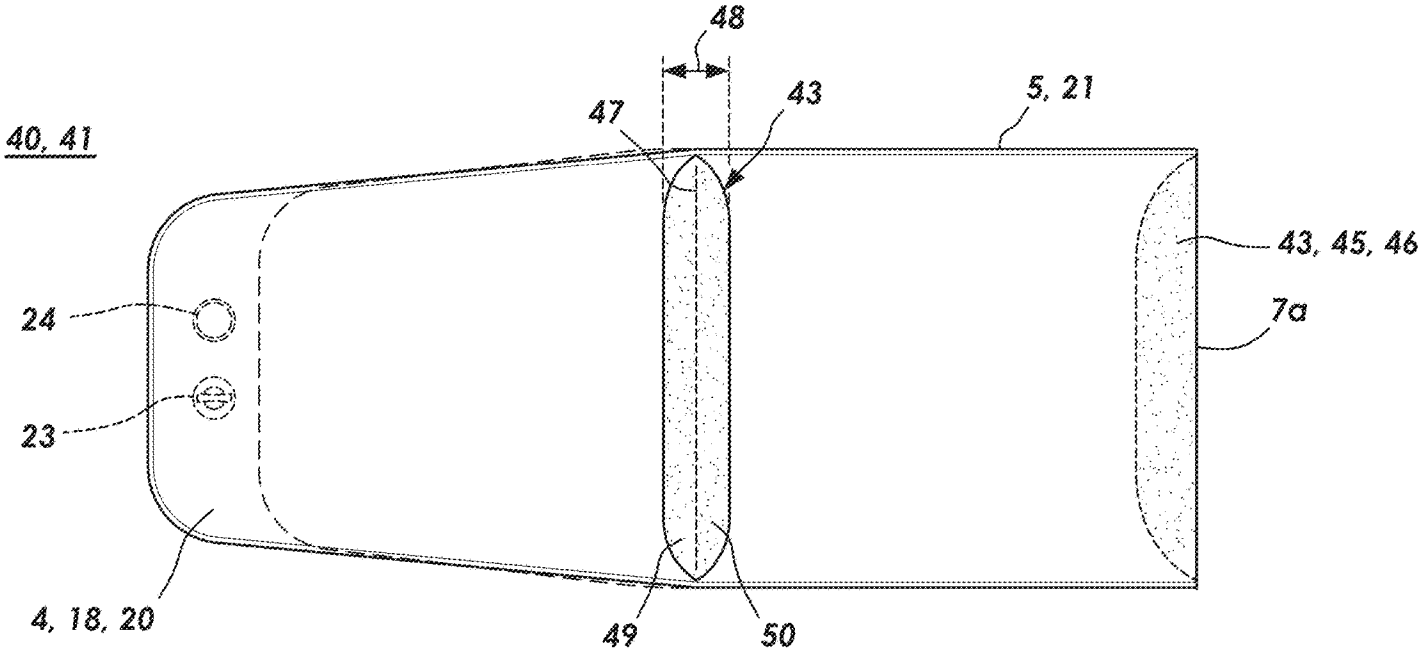
FIG. 14E is a top plan view of the inflatable body folded on the first bend angle axis to adhere the first adhesive area to the second adhesive area of the first adhesive area width and having a second face disposed in a substantially flat condition having a second adhesive area width generally bisected by a second bend angle axis into a first adhesive area adjacent a second adhesive area.
Figure 14F:
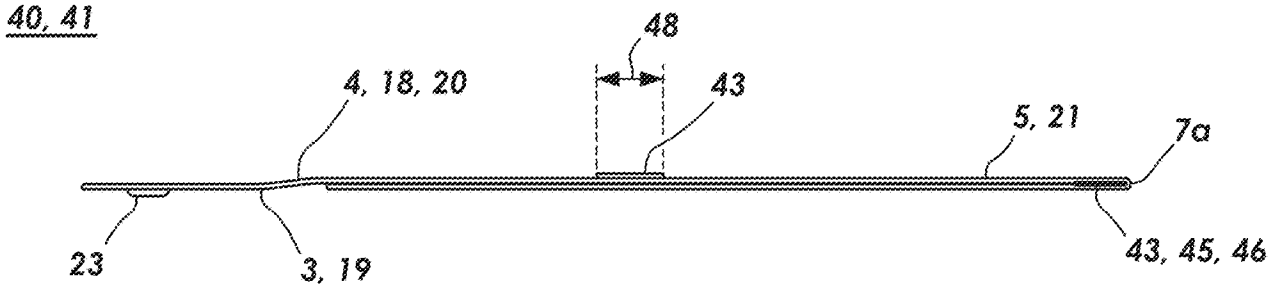
FIG. 14F is a side elevation view of the inflatable body folded on the first bend angle axis to adhere the first adhesive area to the second adhesive area of the first adhesive area width and having a second face disposed in a substantially flat condition having a second adhesive area width generally bisected by a second bend angle axis into a first adhesive area adjacent a second adhesive area.
Figure 14G:
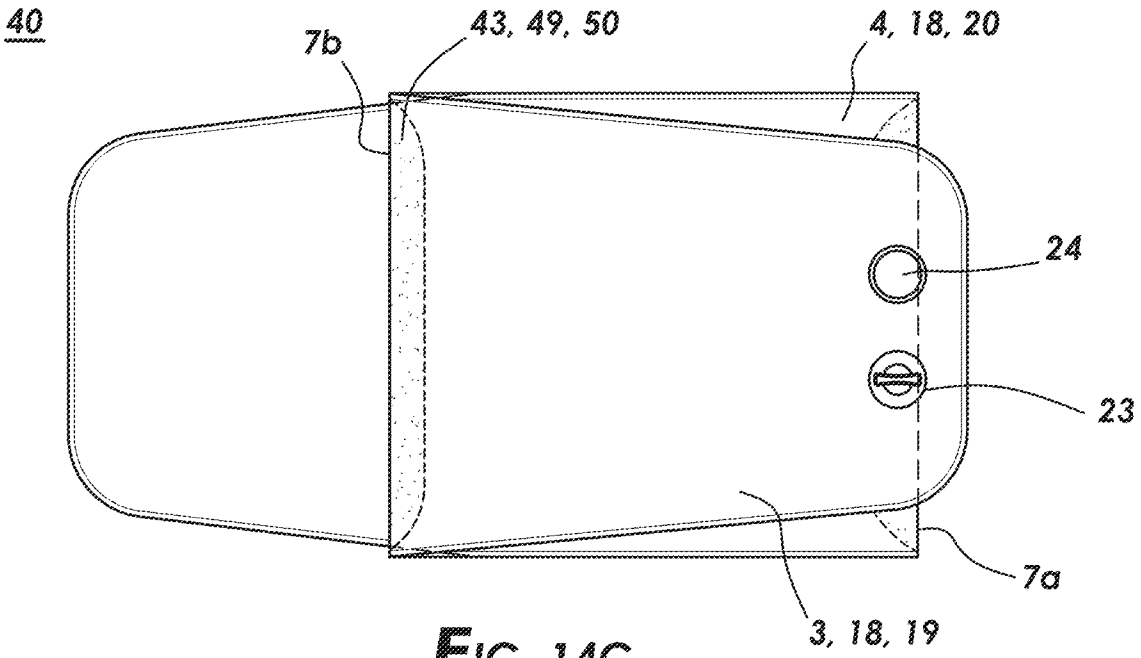
FIG. 14G is a top plan view of the inflatable body folded on the first bend angle axis to adhere the first adhesive area the second adhesive area of the first adhesive area width and folded on the second bend angle axis to adhere the first adhesive area the second adhesive area of the second adhesive area width.
Figure 14H:
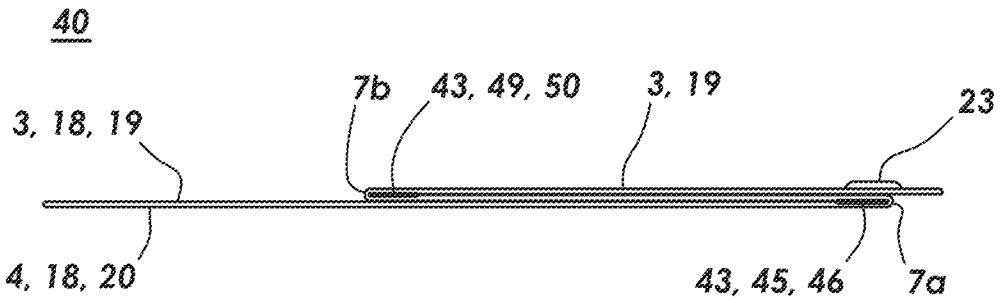
FIG. 14H is a first side elevation view of the inflatable body folded on the first bend angle axis to adhere the first adhesive area the second adhesive area of the first adhesive area width and folded on the second bend angle axis to adhere the first adhesive area the second adhesive area of the second adhesive area width.
Figure 14I:
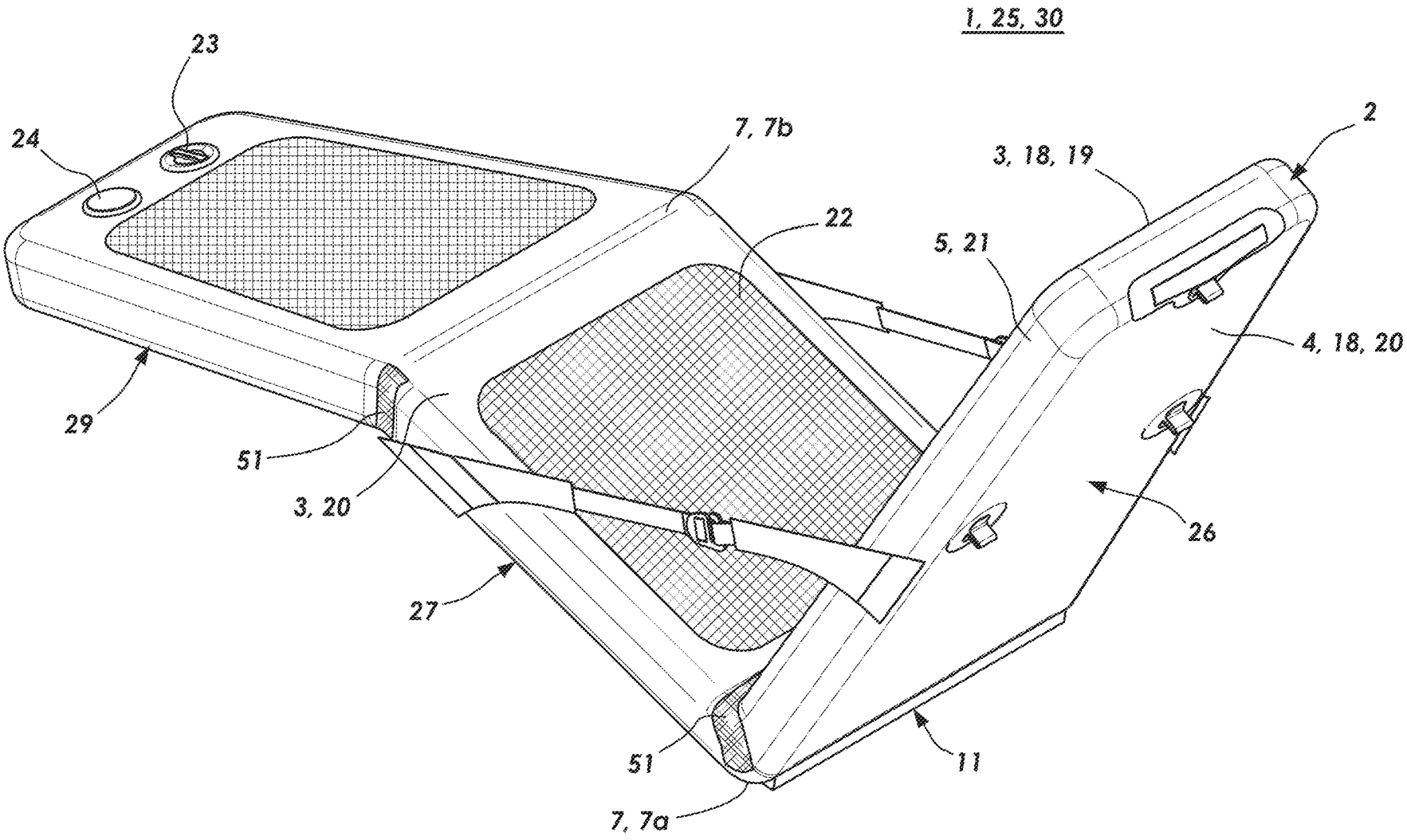

FIG. 14I is a rear perspective view of an embodiment the inflated chair generated by inflating the inflatable body having a first face disposed in a substantially flat condition folded on the first bend angle axis to adhere the first adhesive area the second adhesive area and having the inflatable body folded on the corresponding second bend angle axis to adhere corresponding first adhesive areas adjacent second adhesive areas to produce an embodiment of the inflatable chair having a strip disposed over the seams generated in the first face of the inflatable body at the perimeters of the adhered first adhesive areas to the second adhesive areas.

V. DETAILED DESCRIPTION OF THE INVENTION

Generally, referring to FIGS. 1 through 12, 13A-13G, and 14A-14I illustrate an anti-tip inflatable article (1) (also referred to as an "inflatable article"), a method of making the anti-tip inflatable article (1), and a method of using the anti-tip inflatable article (1).

Figure 9:
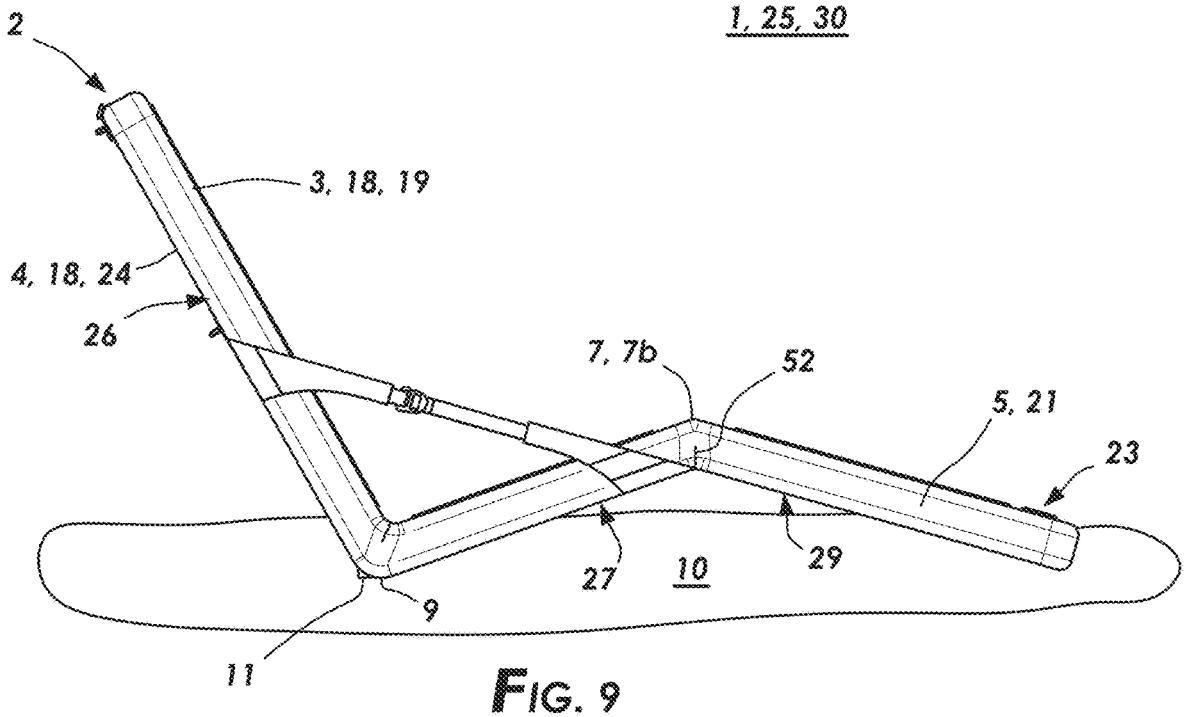
FIG. 9 is a first side elevation view of an embodiment of a chair including an anti-tip device.
Figure 10:
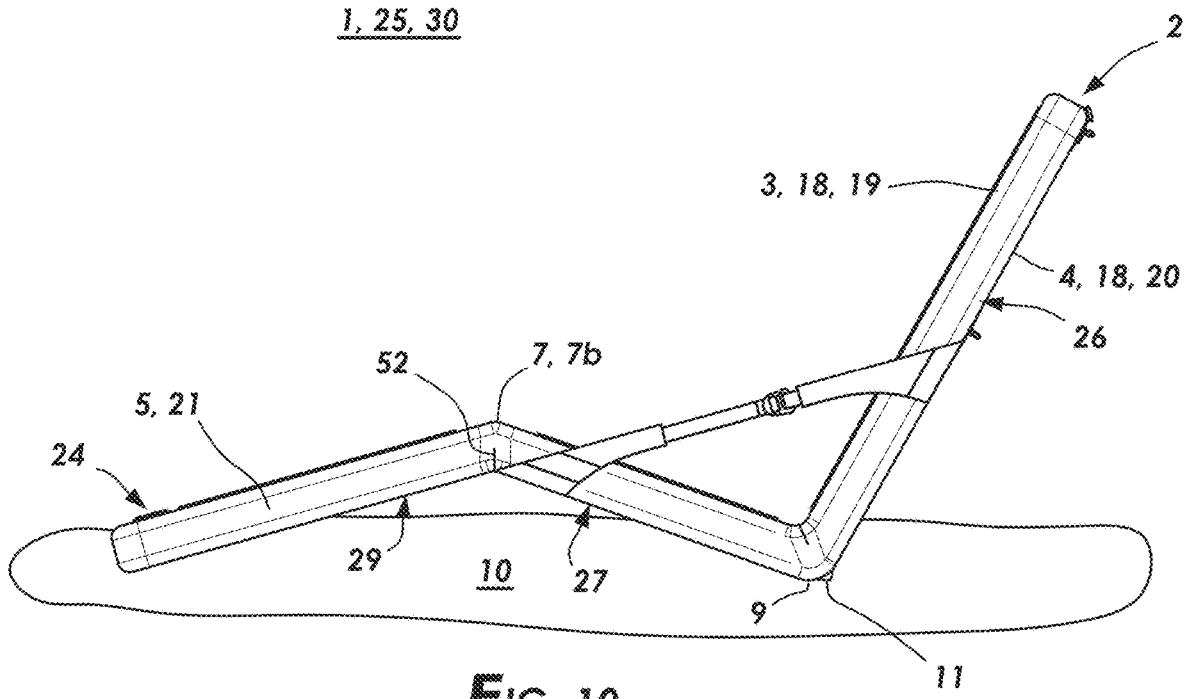
FIG. 10 is a second side elevation view of an embodiment of a chair including an anti-tip device.

Now, with primary reference to FIGS. 1 through 12, which depict illustrative embodiments of an anti-tip inflatable article (1) including an inflatable body (2) having a first face (3) opposite a second face (4) extending to a body periphery (5) defining at least one interior chamber (6), wherein upon inflation the inflatable body (2) has a bend (7) disposed across the first face (3) or the second face (4) to the body periphery (5). The bend (7) disposed across the first face (3) or the second face (4) can define a rotation axis (8) along the points of contact (9) of the inflatable body (2) with a support surface (10). Referring primarily to FIGS. 9 and 10, an anti-tip device (11) can be coupled to the first face (3) or the second face (4) along or proximate the rotation axis (8) of the inflatable body (2). The anti-tip device (11) includes an anti-tip arm (12) extending outward of the rotation axis (8) of the inflatable body (2) to shift the distance (13) of a moment-arm (14) backward from the center of mass (15) of the inflatable body (2). The anti-tip device (11) opposes rotation (16) of the inflatable body (2) about the rotation axis (8) between the points of contact (9) of the inflatable body (2) with the support surface (10).

It has been unexpectedly discovered that in inflatable articles (1) having a bend (7) in the inflatable body (2) that defines a rotation axis (8) along the points of contact (9) of the inflatable body (2) with a support surface (10), the shift in the distance (13) of the moment arm (14) backward from the center of mass (15) of an inflatable body (2) can be accomplished with an anti-tip device (11) having an unexpectedly short an anti-tip arm (12). In particular embodiments, the anti-tip arm (12) can extend outward of the rotation axis (8) entirely along the rotation axis (8) defined by the points of contact (9) of the inflatable body (2) with the support surface (10) or proximate the rotation axis (8) to distribute a rotation force (17) over a sufficient area to allow the inflatable article (1) to be used for the intended purpose without readily tipping over. Additionally, a short anti-tip arm (12) provides a substantial advantage in that the inflatable article (1) in the uninflated condition can be folded or rolled upon itself without removal of the anti-tip device (11) and without addition of substantial volume to the uninflated condition in the folded or rolled condition.

Embodiments of inflatable articles (1) can be made using drop stitch material (18). Drop stitch material (18) can be produced by the drop stitch method, in which two fabric webs, such as, denier polyester fabric webs, are separate but joined by a plurality of threads. The plurality of threads can have a length which disposes the two fabric webs at distance apart when the inflatable article (1) is filled with air or other gas. The length of the threads can occur in a range of about 1 inches to about 18 inches. Thereby, upon inflation of the inflatable article (1), the two fabric webs occur a distance apart within a range of about 1 inch to about 18 inches. Depending upon the application, the length of the threads can be selected from the group consisting of: about 1.0 inch to about 3.0 inches, about 2.0 inches to about 4.0 inches, about 3.0 inches to about 5.0 inches, about 4.0 inches to about 6.0 inches, about 5.0 inches to about 7.0 inches, about 6.0 inches to about 8.0 inches, about 7.0 inches to about 9.0 inches, about 8 inches to about 10.0 inches, about 9.0 inches to about 11 inches, about 10.0 inches to about 12.0 inches, about 11.0 inches to about 13.0 inches, about 12 inches to about 14 inches, about 13 inches to about 15 inches, about 14 inches to about 16 inches, about 15 inches to about 17 inches, and about 16 inches to about 18 inches. In the illustrative embodiments shown in the Figures, the length of the plurality of threads can be about 3 inches, whereby upon inflation of the inflatable article (1) the distance between the first face (3) and the second face (4) of the inflatable body (2) will be about 3 inches. However, the illustrative examples using a three-inch drop stitch material is not intended to preclude embodiments of inflatable articles (1) using the drop stitch material (18) disposing the first face (3) at a lesser or a greater distance from the second face (4) of the inflatable body (2).

Embodiments using drop stitch material (18) have substantial mechanical strength upon inflation. The two interconnected fabric webs can be cut to delimit a first face fabric material (19) and a second face fabric material (20) of the inflatable body (2). The first face fabric material (19) and the second face fabric material (20) can include a periphery margin material (21) which can be overlappingly adhered to afford an airtight inflatable interior chamber (6), or the periphery margin material (21) can comprise a separate piece of material overlappingly adhered to the first face fabric material (19) and the second face fabric material (20) to afford the at least one inflatable interior chamber (6). The periphery margin material(s) (21) can be adhered together by stitching, waterproof adhesive (such as, an epoxy, a polyurethane, a polyimide, and a cyanoacrylate), thermal bonding, or thermal welding, radio frequency welding, lamination, and combinations thereof. The first face fabric material (19) and the second face fabric material (20) of the inflatable body (2) can be overlaid with additional fabric layers (22) to confer additional strength, rigidity, or texture to the first face fabric material (19) and/or second face fabric material (20). An illustrative example of the additional fabric layers (22) can comprise fabric layers coated with a synthetic plastic such as a vinyl, a polyvinylchloride, a polyester, a polyurethane, a silicone, and combinations thereof.

Embodiments of inflatable articles (1) can include an inflation/deflation valve (23) which in the open condition allows air or other gas to flow into or flow out of the inflatable interior chamber (6) and in the closed condition prevents air or other gas from flowing out the inflatable interior chamber (6) to maintain the inflated condition of the inflatable article (1). A wide variety of inflation/deflation valves (23) can be utilized with embodiments of the inflatable article (1). The inflation/deflation valve (23) may be a valve which has two positions, one which allows the inflatable article (1) to be inflated and one which allows the inflatable article (1) to be deflated. The inflation/deflation valve (23) can be configured to sealably engage the drop stitch material (18) of the inflatable article (1). The inflation/deflation valve (23) can be configured for use with manual or electric pumps. According to embodiments, the inflation/deflation valve (23) may be any suitable valve used for inflatable articles (1). As illustrative examples, a Halkey Roberts valve (H-valve), a Leafield valve, a Maravia valve, a Military valve, a Boston valve, and Bravo 2005 push-push valve.

Embodiments of the inflatable article (1) can further include a pressure relief valve (24). As an illustrative example, a pressure relief valve (24) may be any suitable pressure relief valve used on inflatable articles (1). As illustrative examples, the pressure relief valve (24) can be a Leafield A6 pressure relief valve (Leafield Marine Ltd., Atworth, UK). The pressure relief valve (24) can be configured to release air or other gas from the inflatable interior chamber (6) at a specified pressure, either due to overinflation, increase in temperature, or compression of the inflated article (1), or other causes. The inflation/deflation valve (23) and pressure relief valve (24) can be integral or separate valves that can be disposed at any position on the inflatable article (1).

Embodiments of the inflatable article (1), with or without the pressure relief valve (24), can be inflated to a pressure sufficient to obtain an operable configuration of the inflatable article (1). According to embodiments, the inflatable article (1) can be inflated to a specified pressure between about 3 pounds per square inch to about 25 pounds per square inch (psi). Depending upon the application, the pressure can be selected from the group consisting of: 4 psi, 5 psi, 6 psi, 7 psi, 8 psi, 9 psi, 10 psi, 11 psi, 12 psi, 13 psi, 14 psi, 15 psi, 16 psi, 17 psi, 18 psi, 19 psi, 20 psi, 21 psi, 22 psi, 23 psi, 24 psi, 25 psi, 26 psi, 27 psi, 28 psi, and 30 psi. Typical pressures for an inflatable article (1) made from drop stitch material (18) are between about 3 psi to about 25 psi. Thus, when the inflatable article (1) includes a pressure relief valve (24), the maximum inflation pressure of the inflatable interior chamber (6) can be capped at any of these specified pressures.

Figure 1:
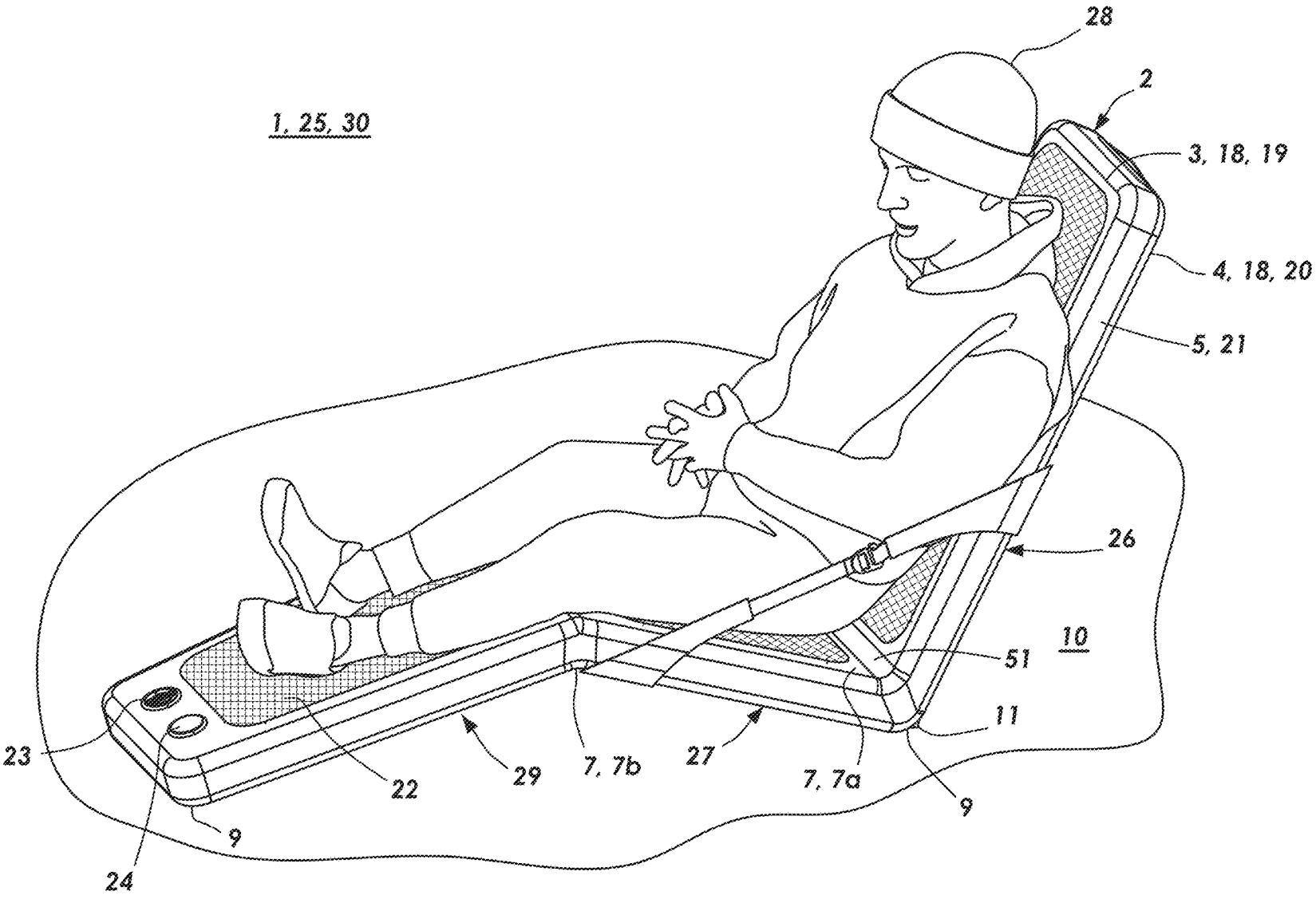
FIG. 1 illustrates a method of using an embodiment of a chair including an anti-tip device.
Figure 2:
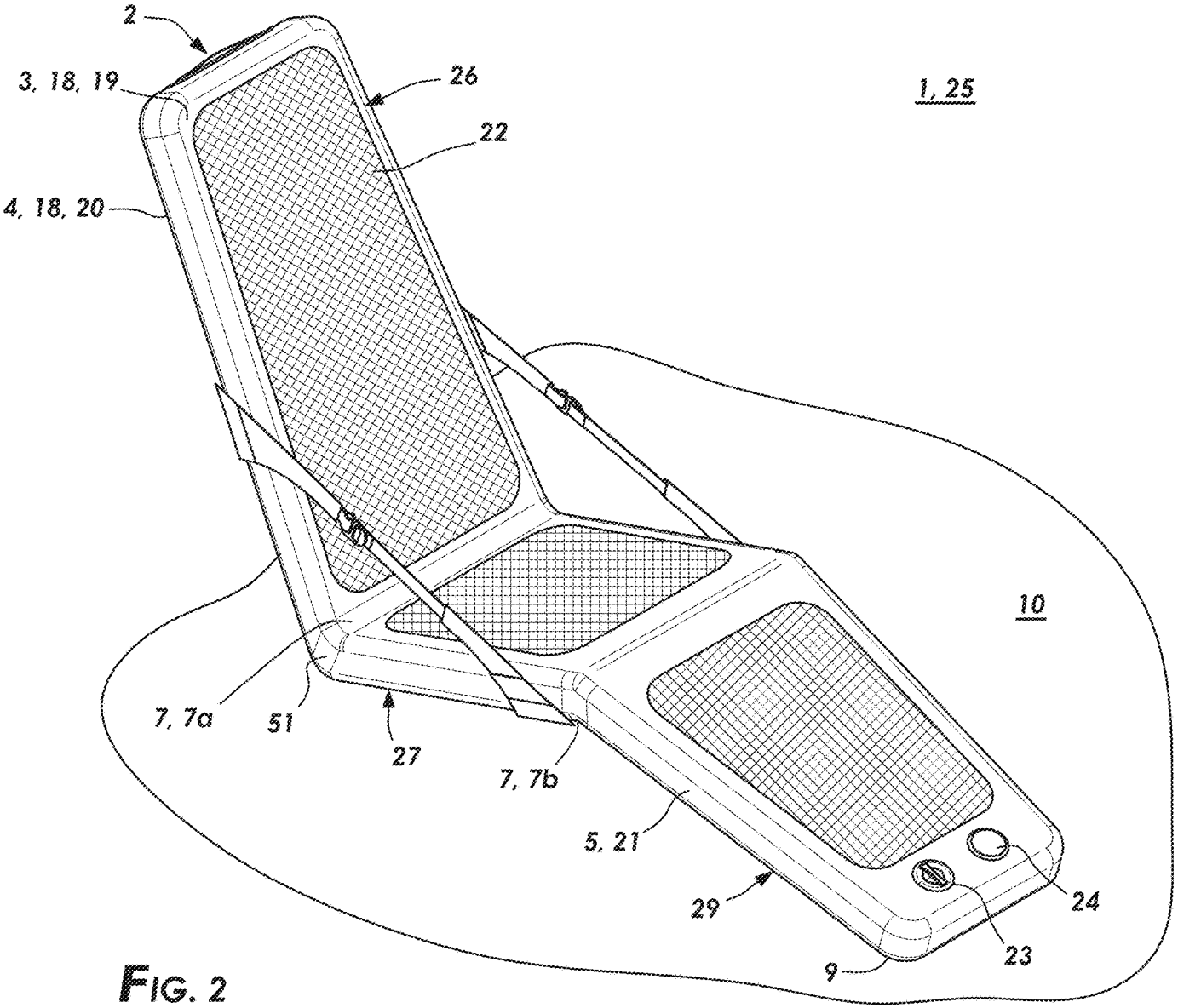
FIG. 2 is a front perspective view of an embodiment of a chair including an anti-tip device.
Figure 3:
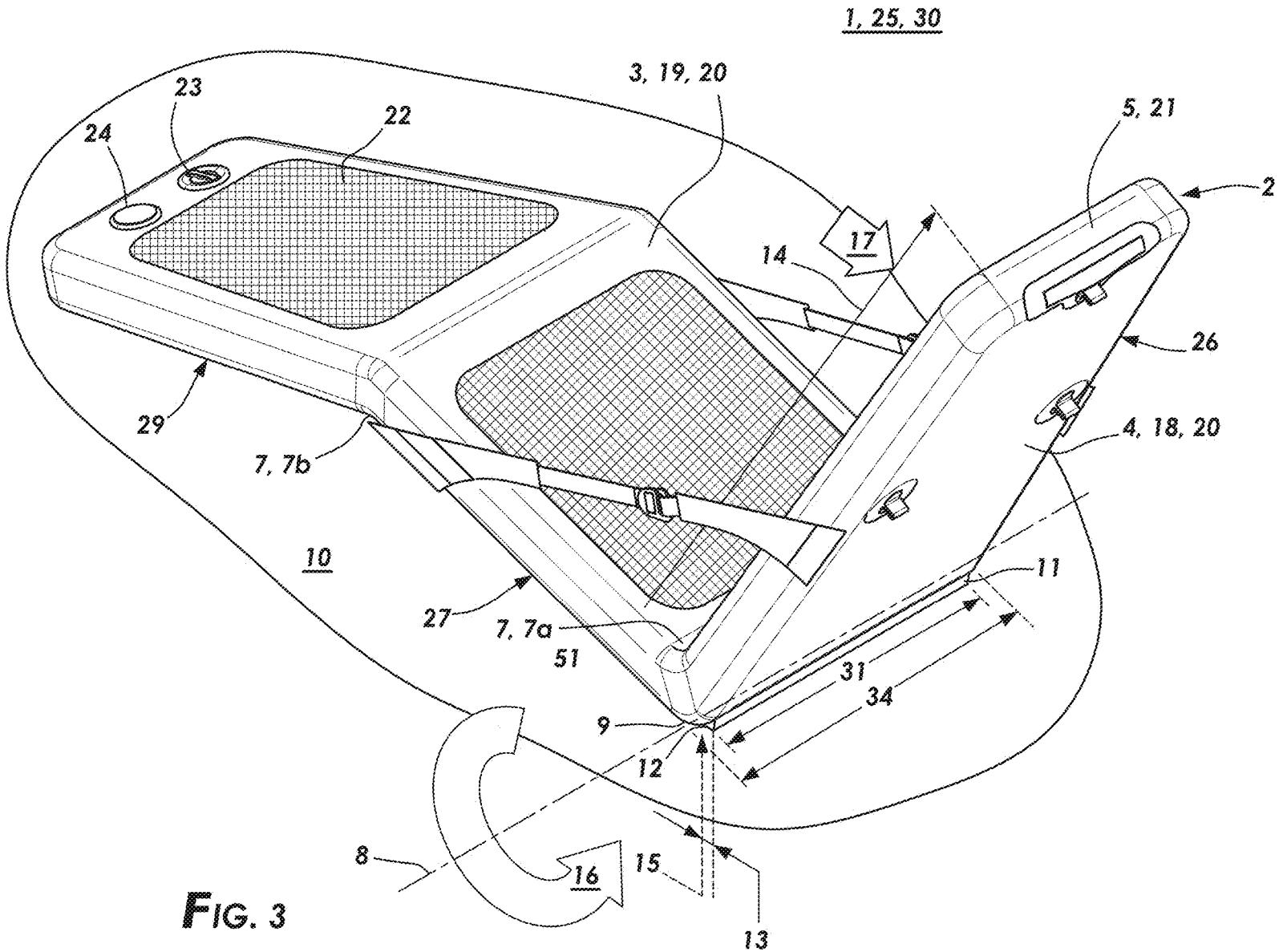
FIG. 3 is a rear top perspective view of an embodiment of a chair including an anti-tip device.
Figure 4:
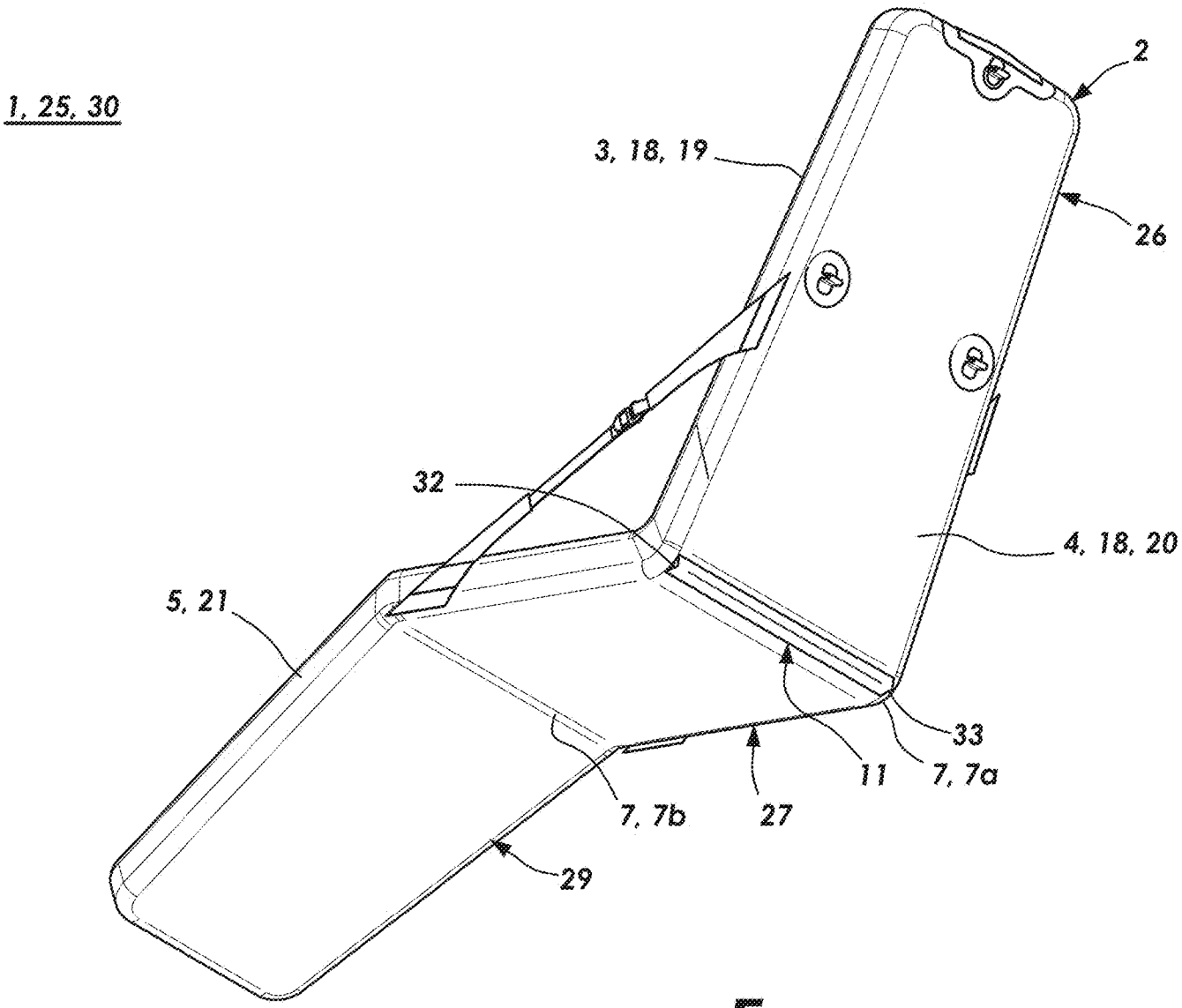
FIG. 4 is a rear bottom perspective view of an embodiment of a chair including an anti-tip device.
Figure 6:
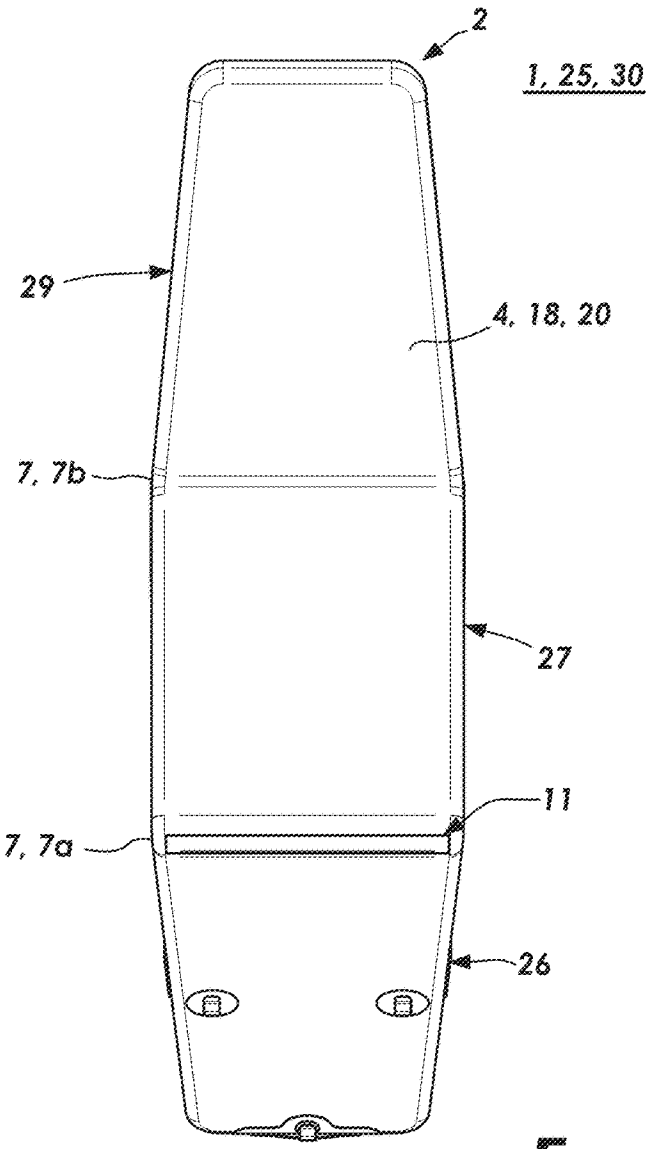
FIG. 6 is a bottom plan view of an embodiment of a chair including an anti-tip device.
Figure 5:
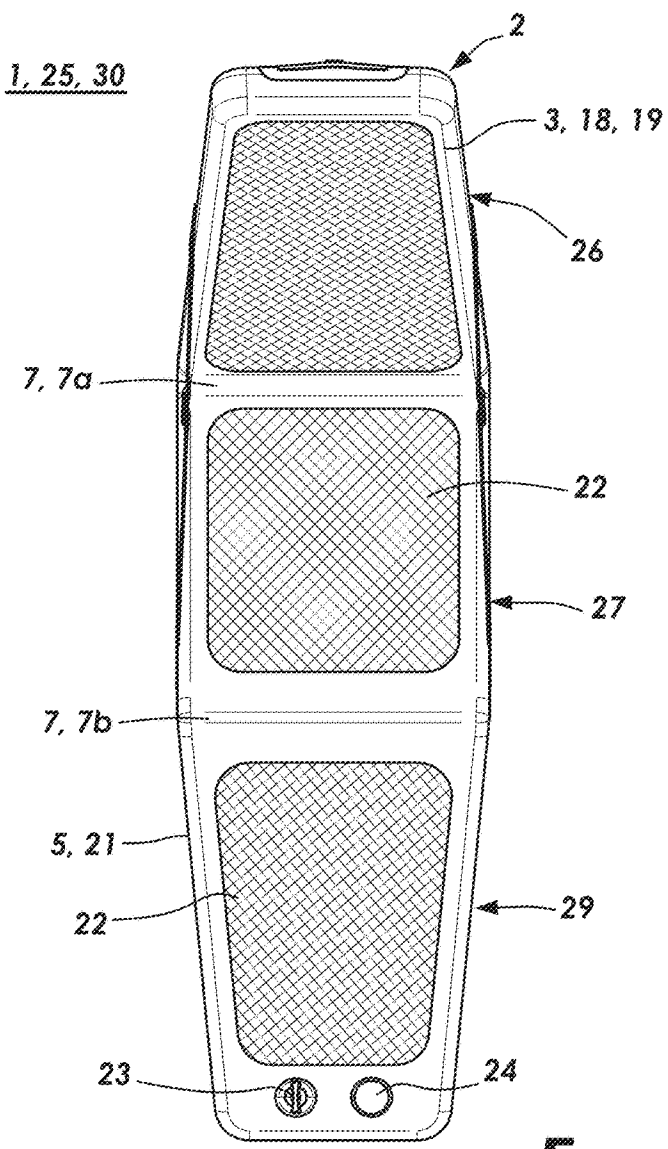
FIG. 5 is a top plan view of an embodiment of a chair including an anti-tip device.
Figure 8:
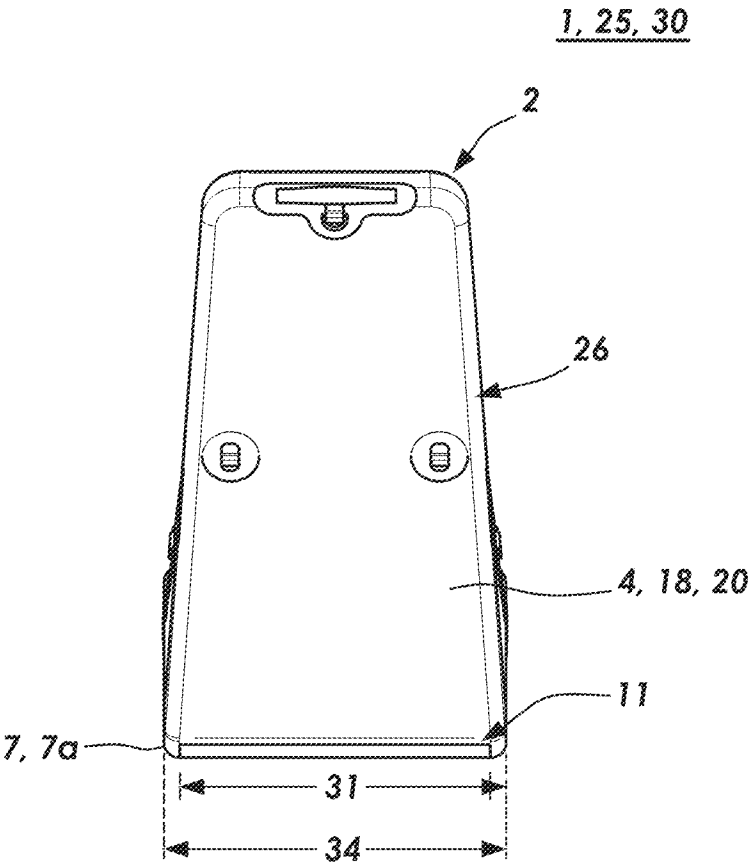
FIG. 8 is a rear elevation view of an embodiment of a chair including an anti-tip device.
Figure 7:
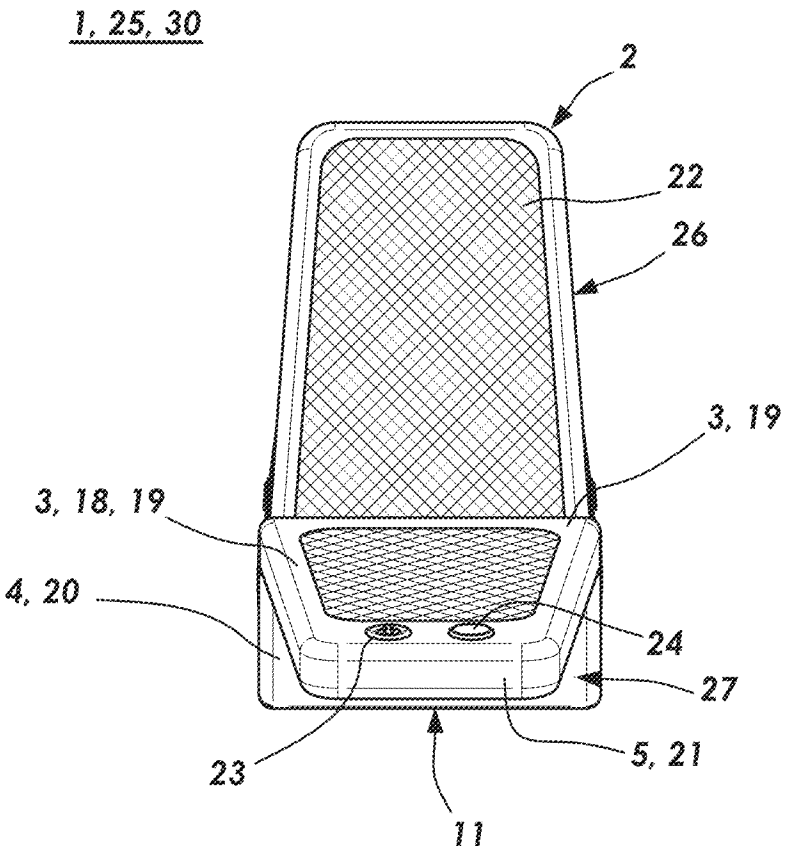
FIG. 7 is a front elevation view of an embodiment of a chair including an anti-tip device.

Again, with primary reference to FIGS. 1 through 10, an illustrative example of an anti-tip inflatable article (1) can comprise an anti-tip inflatable chair (25) including an inflatable body (2) having a first face (3) opposite a second face (4) extending to a body periphery (5) defining only one, or at least one inflatable interior chamber (6). Upon inflation, the inflatable body (2) can have a first bend (7*a*) disposed across the first face (3) and the second face (4) to the body periphery (5). The first bend (7*a*) in the inflatable body (2) defines a back panel (26) and a seat panel (27) of the anti-tip inflatable chair (25). The first bend (7*a*) disposed across the first face (3) and the second face (4) to the body periphery (5) defines a rotation axis (8) along the points of contact (9) of the first bend (7*a*) of the inflatable body (2) with a support surface (10) (as shown in the example of FIG. 1). An embodiment of the anti-tip device (11) can be coupled along or adjacent the rotation axis (8) to shift the distance (13) of a moment-arm (14) backward from the center of mass (15) of the inflatable body (2). The anti-tip device (11) opposes rotation (16) of the inflatable body (2) about the rotation axis (8) defined by the points of contact (9) of the first bend (7*a*) of the inflatable body (2) with the support surface (10) at rest or during use of the anti-tip inflatable chair (25) by a person (28) seated against the back panel (26) and the seat panel (27). In particular embodiments, the anti-tip inflatable chair (25) or other inflatable article (1) can further include a second bend (7*b*) disposed across the first face (3) and the second face (4) to define a chaise panel (29) extending from the seat panel (27) to provide an anti-tip inflated chaise lounge (30). However, the invention is not limited to the inflatable articles (1) or the number of bends (7) depicted in the Figures, but rather the examples afford sufficient examples of inflatable articles (1) to enable a person of ordinary skill in the art to make and use inflatable articles (1) that include one or more bends (7) in the first face (3) and/or the second face (4) which can correspondingly define one or more rotation axes (8) along the points of contact (9) of the inflatable body (2) with a support surface (10) along which or adjacent to the anti-tip device (11) can be coupled to oppose rotation (16) of the inflatable body (2) whether at rest during conventional use.

Figure 11:
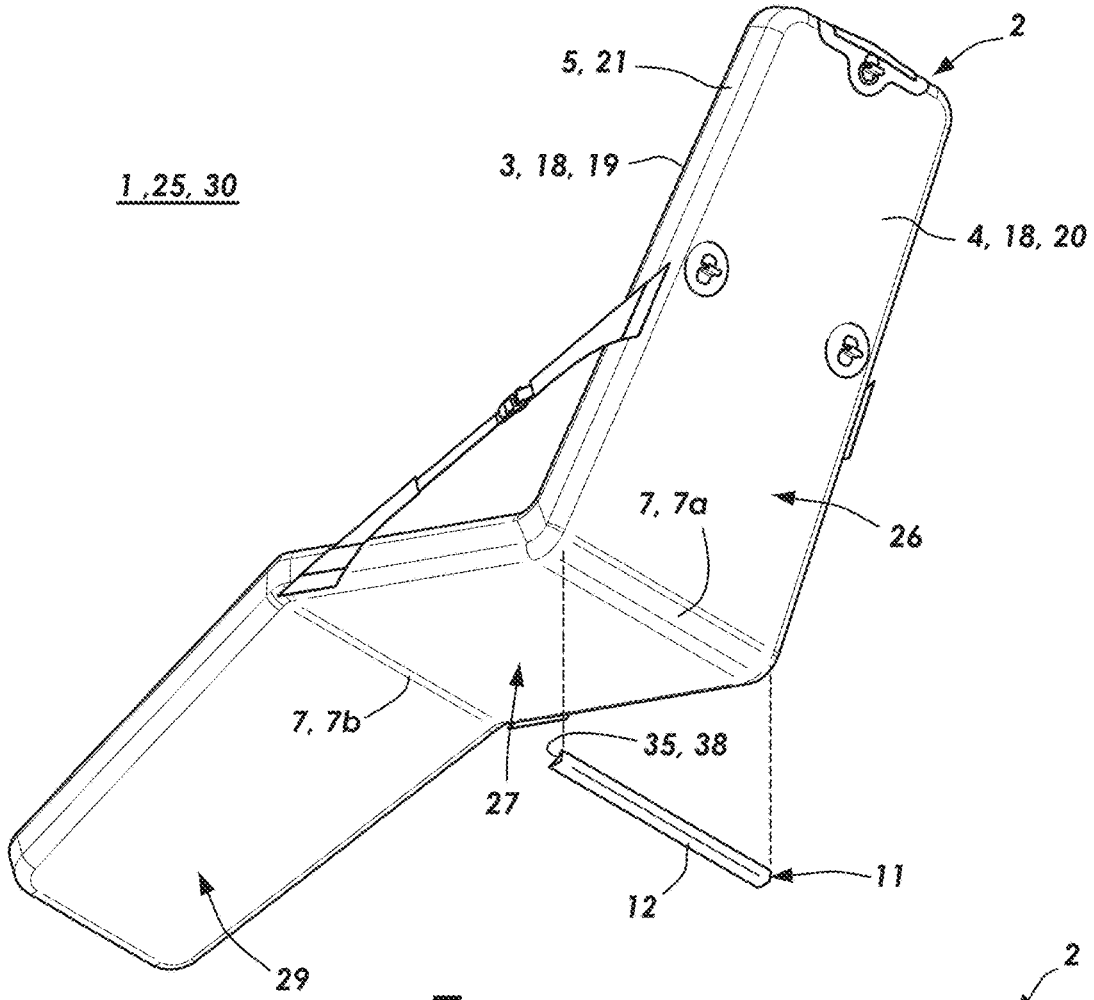
FIG. 11 is a rear bottom perspective exploded view of an embodiment of a chair including an anti-tip device.
Figure 12:
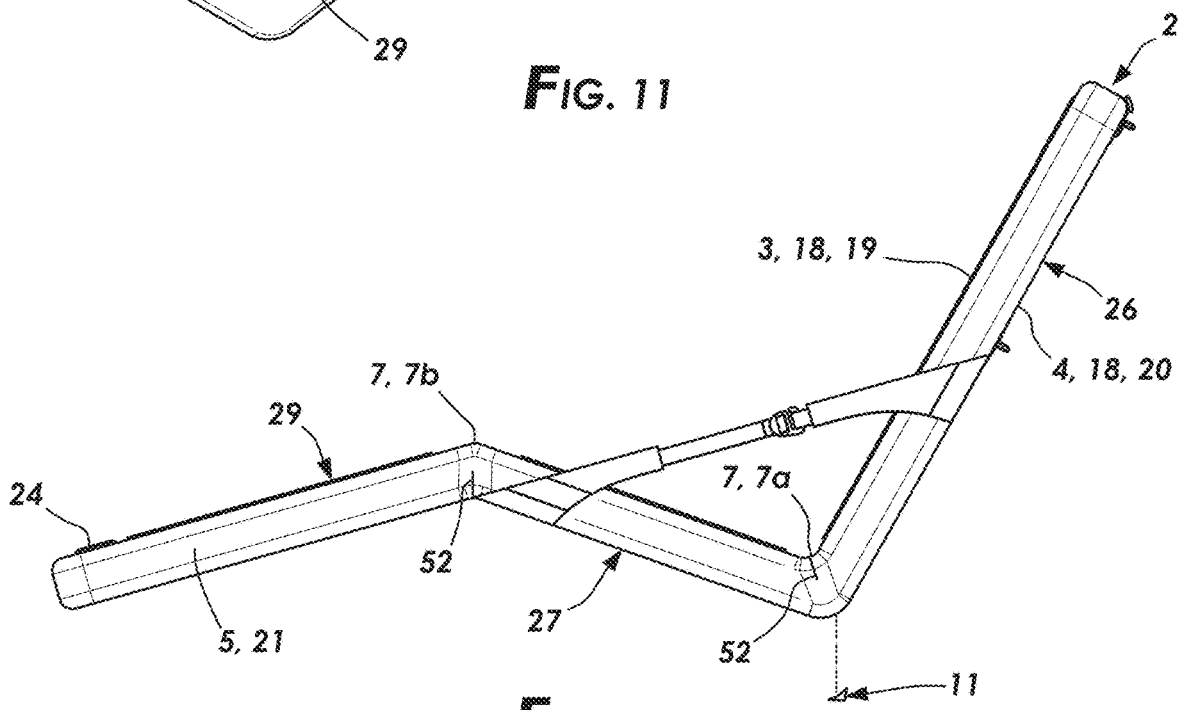
FIG. 12 is a second side elevation exploded view of an embodiment of a chair including an anti-tip device.

Now, with primary reference to FIGS. 11 and 12, an embodiment of the anti-tip device (11) can be coupled along, adjacent to, or in close fixed spatial relationship to the rotation axis (8) of the inflatable body (2). As illustrative examples, the anti-tip device (11) can be coupled to the inflatable body (2) by: stitching, waterproof adhesive (such as, an epoxy, a polyurethane, a polyimide, and a cyanoacrylate), thermal bonding, thermal welding, radio frequency welding, lamination, and combinations thereof.

Figure 13A:
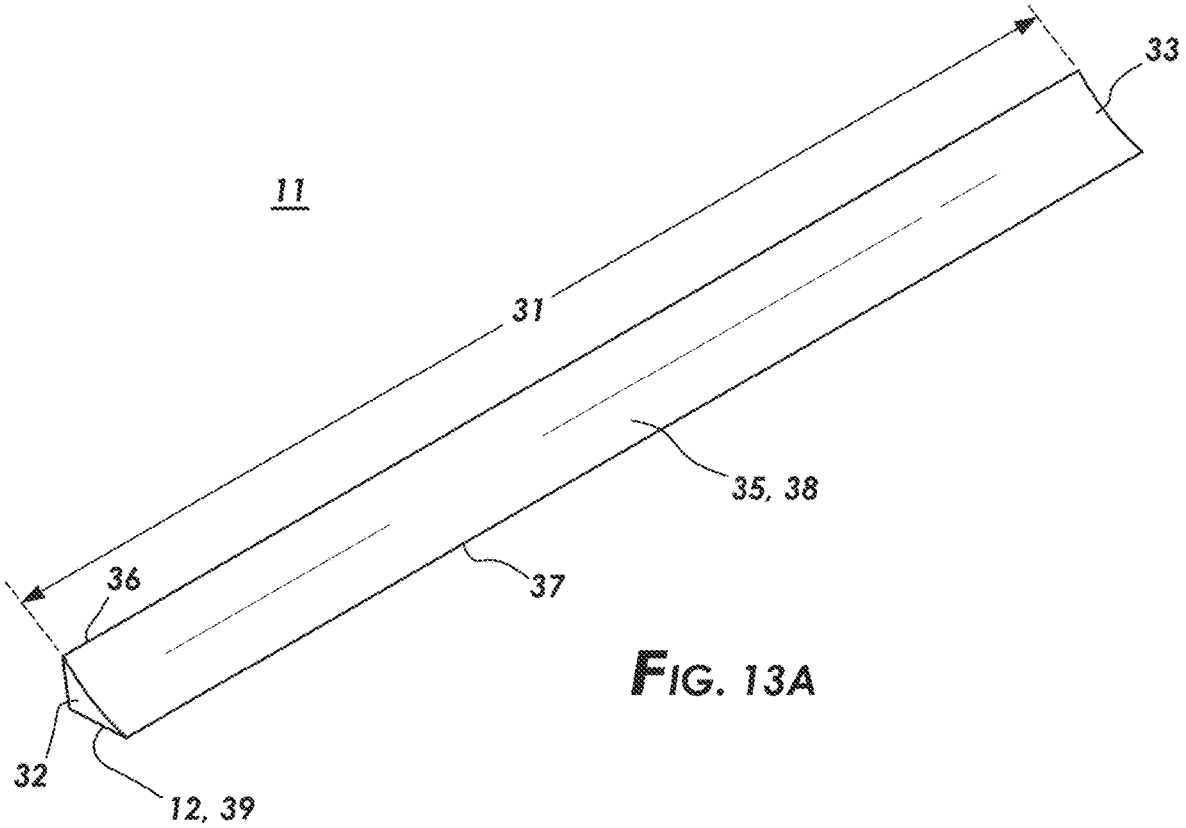
FIG. 13A is a front perspective view of an embodiment of an anti-tip device.
Figure 13B:
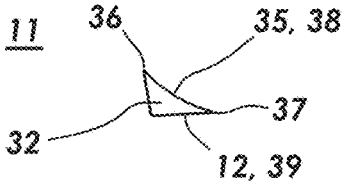
FIG. 13B is a first end elevation view of an embodiment of an anti-tip device.
Figure 13C:
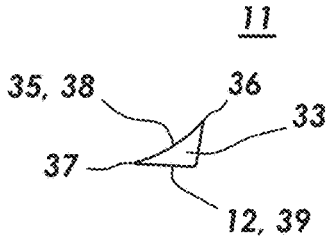
FIG. 13C is a second end elevation view of an embodiment of an anti-tip device.
Figure 13D:
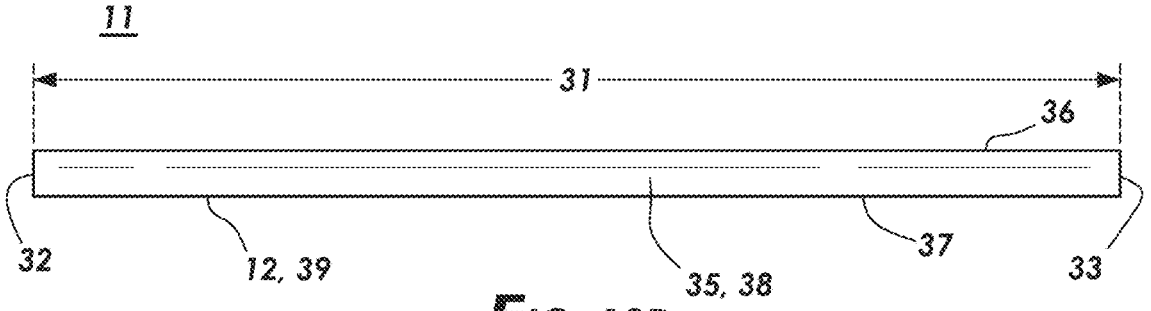
FIG. 13D is a front elevation view of an embodiment of an anti-tip device.
Figure 13E:
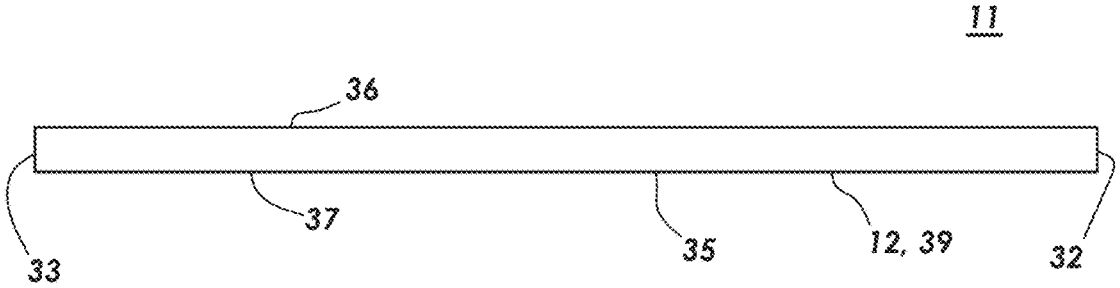
FIG. 13E is a rear elevation view of an embodiment of an anti-tip device.
Figure 13F:
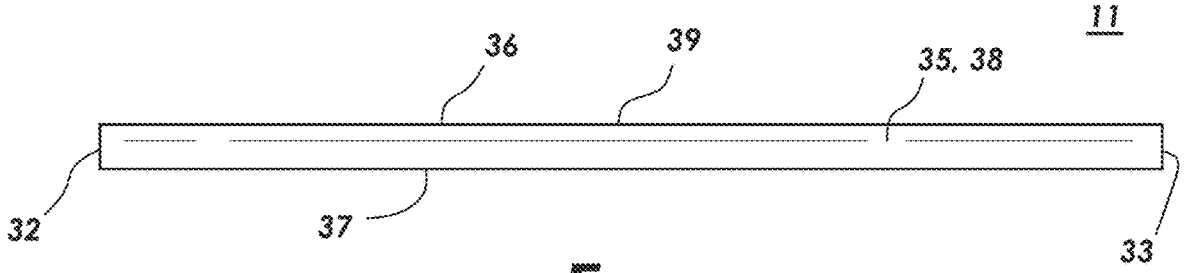
FIG. 13F is a top plan view of an embodiment of an anti-tip device.
Figure 13G:
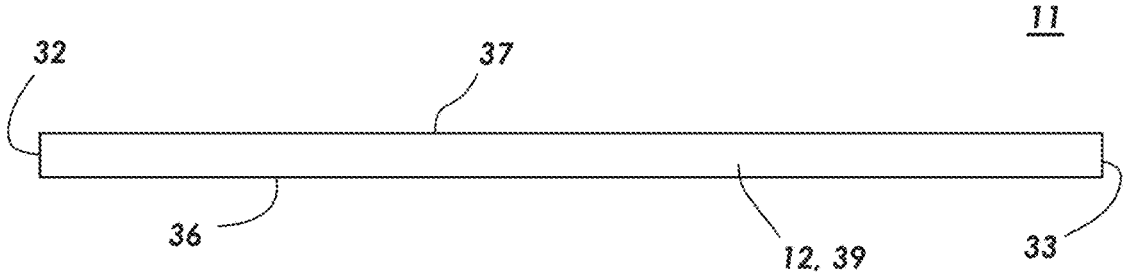
FIG. 13G is a bottom plan view of an embodiment of an anti-tip device.

Now, with primary reference to FIGS. 13A through 13G, depict an illustrative example of an anti-tip device (11) which can be coupled to an inflatable article (1) along, or adjacent to, or proximate the rotation axis (8) defined by a bend (7) in the inflatable article (1). Embodiments of the anti-tip device (11) include a length (31) disposed between a first end (32) and a second end (33). Typically, the anti-tip device (11) coupled to the inflatable article (1) comprises one continuous piece as depicted in FIG. 11; however, the term "anti-tip device" encompasses one continuous piece or a plurality of discontinuous pieces coupled to the inflatable article (1). In the example of the anti-tip inflatable chair (25) shown in the example of FIG. 1, the anti-tip device (11) comprises one continuous piece having a length (31) of about eighteen inches (about 457 millimeter ("mm")) that is coupled along or proximate the rotation axis (8) at the first bend (7*a*) of the inflatable body (2) having an inflatable body width (34) of about twenty inches (about 500 mm). As shown in FIGS. 13A, embodiments of the anti-tip device (11) include an anti-tip base (35) configured or adapted to affix to the inflatable body (2) along or proximate the rotation axis (8). In the illustrative example of 13A, the anti-tip base (35) extends between a liner first edge (36) disposed in generally parallel fixed spatial relation to a liner second edge (37); although suitable embodiments may not include a linear first edge (36) and a liner second edge (37) but may include non-linear edges. The anti-tip base (35) need only afford a configuration that can remain affixed to the inflatable body (2) during normal use. In the illustrative example of FIGS. 13B and 13C, the anti-tip base (35) can include a curved surface (38) between the liner first edge (36) and the linear second edge (37) to approximate the curvature of the bend (7, 7*a*) defining the rotation axis (8) of the inflatable body (2). However, the anti-tip base (35) can be suitable for use with a flat surface.

Again, with primary reference to FIGS. 13A through 13G, embodiments of the anti-tip device (11) include an anti-tip arm (12) extending outward of the rotation axis (8) of the inflatable body (2) to shift the distance (13) of a moment-arm (14) backward from the center of mass (15) of the inflatable body (2). The anti-tip device (11) opposes rotation of the inflatable body (2) about the rotation axis (8) between the points of contact (9) of the inflatable body (2) with the support surface (10) during rest or use by a seated person (28). In the example of FIG. 1, where conventional use comprises a person (28) weighing between about 120 pounds to about 200 pounds seated on the seat panel (27) and leaning against the back panel (26) of the anti-tip inflatable chair (25), the anti-tip arm can extend a distance (13) outward of the anti-tip base (35). In the illustrative example of the anti-tip inflatable chair (25) having a moment arm of about 18 inches to about 20 inches (about 460 mm to about 500 millimeters), the anti-tip arm (12) only extends about 1 inch to about 2 inches (about 25 mm to about 50 mm). This is an unexpectedly short distance given the moment arm (14) of the back panel (26) of the inflatable body (2) and the rotation force (17) generated by a person (28) seated in the anti-tip inflatable chair (25). In the illustrative example of Figures, the anti-tip arm (11) comprises a continuous flat surface (39) adapted to or configured to engage the support surface (10). This configuration defines an anti-tip arm (12) having a surface area of about 18 square inches to about 27 square inches (about 11,615 square mm to about 17,420 square mm) which is sufficient to spread the rotation force (17) over a sufficient area to resist or prevent the anti-tip inflatable chair (25) from tipping during normal use. However, in particular embodiments, the surface of the anti-tip arm (12) need not necessarily be a continuous flat surface and while the anti-tip arm edge distal from the anti-tip base (35) can contact the support surface (10) the medial area between the anti-tip base and the anti-tip distal edge need not engage the support surface (10).

Now, with primary reference to FIGS. 14A through 14B, which depict a method of making the inflatable articles (1) having one or more bends (7) in the first face (3) or the second face (4) which can define a rotation axis (8) between the points of contact (9) of the inflatable body (2) with the support surface (10). FIGS. 14A through 14I provide an illustrative example of making the anti-tip inflatable chair (25) depicted in FIGS. 1 through 12. Now, with reference to FIGS. 14A and 14B, during production of an uninflated article (40), the uninflated body (40) of an inflatable article (1) can be disposed in substantially flat condition (41) on a support surface (10). The term "substantially flat" means the first face (3) or a second face (4) of the uninflated article (40) laid on a support surface (10) as shown in the illustrative examples of FIGS. 14A and 14B or in a folded condition disposed on a support surface (10) as shown in the illustrative example of FIG. 14C through 14H, with the uninflated article (40) having some unevenness due to the properties of the drop stitch materials (18) of the uninflated article (40) or the support surface (10).

Again, with reference to FIGS. 14A and 14B, a first bend angle axis (42) (also referred to as "a first bend angle line" depicted as a broken line in the Figures) can extend across the first face (3) or the second face (4) to the body periphery (5) which upon inflation defines the inflated anti-tip chair back panel (26) adjacent the inflated anti-tip chair seat panel (27). An adhesive (43) (shown in the example of FIG. 14B as a stippled area) can be applied to the first face (3) having a first adhesive area width (44) generally bisected by the bend angle line (42) to define a first adhesive area (45) adjacent a second adhesive area (46).

Now, with primary reference to FIGS. 14C and 14D, the method in the example of the inflatable anti-tip inflatable chair (25) can further include folding the uninflated article (40) on or around a first bend angle line (42) to adhere the first adhesive area (45) to the second adhesive area (46) to generate the first bend (7*a*) in the inflatable body (2).

Now, with primary reference to FIGS. 14E and 14F, the method in the example of the anti-tip inflatable chair (25) can further include disposing the first face (3) on the support surface (10) rendering the second face (4) of the uninflated article (40) in a substantially flat condition (41). The method can further include identifying a second bend angle line (47) extending across the second face (4) of the uninflated article (40) to the body periphery (5). In the example of FIG. 14E, the second bend angle line (47) correspondingly identifies the second bend angle (7*b*) defining the chaise panel (29) extending from the chair seat panel (27). The method can further include applying an adhesive (43) to the second face (4) of the uninflated article (40) along the identified second bend angle line (47) (shown in the example of FIG. 14E as a stippled area) having a second adhesive area width (48) generally bisected by the second bend angle line (47) to define a first adhesive area (49) adjacent a second adhesive area (50).

Now, with primary reference to FIGS. 14G and 14H, the method in the example of the anti-tip inflatable chair (25) can further include folding the uninflated article (40) on the second bend angle line (47) to adhere the corresponding first adhesive area (49) to the second adhesive area (50) (as shown in the examples of FIG. 14G) to generate the second bend (7*b*) in the inflatable body (2).

Now, with primary reference to FIG. 14I, the method in the example of the anti-tip inflatable chair (25) can further include inflating the inflatable body (2) with sufficient pressure to present the first bend (7*a*) and the second bend (7*b*) in the anti-tip inflatable chair (25). With the inflatable body (2) inflated to present the first bend (7*a*) and the second bend (7*b*) in the anti-tip inflatable chair (25), a strip (51) can, but need not necessarily, be adhered over and along seams (52) generated in the first face (3) and the second face (4) of the inflated article (1) at the perimeters of the corresponding adhered first adhesive areas (45)(49) to the second adhesive areas (46)(50). The adhered strip (51) resists separation of the adhered first adhesive areas (45)(49) from the second adhesive areas (46)(50). In particular embodiments, the strip (51) can comprise a flat strip of polyvinylchloride or other suitable material conformable to the seams (52).

Now, with primary reference to FIGS. 11 and 12 and 14I, the method can further include affixing the anti-tip device (11) along, adjacent or proximate to the rotation axis (8) defined by the bend (7) that defines the points of contact (9) with the support surface (10). In a particular embodiments, the method can include affixing the anti-tip device (11) after the step of folding the uninflated article (40) on or around the bend angle line to adhere the first adhesive area to the second adhesive area to generate the bend (7) in the inflatable body (2) that will define the points of contact point (9) with the support surface (10), as shown in the example of FIG. 14C for anti-tip inflatable chair (25) the anti-tip device (11) can be affixed along, adjacent or proximate to the rotation axis (8) defined by the first bend angle axis (42).

As can be easily understood from the foregoing, the basic concepts of the present invention may be embodied in a variety of ways. The invention involves numerous and varied embodiments of an inflatable anti-tip article and methods for making and using such inflatable anti-tip article including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "fold" should be understood to encompass disclosure of the act of "folding"—whether explicitly discussed or not—and, conversely, were there is a disclosure of the act of "folding", such a disclosure should be understood to encompass disclosure of a "fold" and even a "means for folding". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Additionally, for the purposes of the present invention, the term "integrated" when referring to two or more components means that the components (i) can be united to provide a one-piece construct, a monolithic construct, or a unified whole, or (ii) can be formed as a one-piece construct, a monolithic construct, or a unified whole. Said another way, the components can be integrally formed, meaning connected together so as to make up a single complete piece or unit, or so as to work together as a single complete piece or unit, and so as to be incapable of being easily dismantled without destroying the integrity of the piece or unit.

Thus, the applicant(s) should be understood to claim at least: i) each of the inflatable anti-tip articles herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The elements following an open transitional phrase such as "comprising" may in the alternative be claimed with a closed transitional phrase such as "consisting essentially of" or "consisting of" whether or not explicitly indicated the description portion of the specification.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. An inflatable article, comprising:

an inflatable body having a first face opposite a second face extending to a body periphery, wherein upon inflation said inflatable body has a bend extending to said body periphery, wherein said bend is disposed across said second face defines a rotation axis along a plurality of points of contact of the inflatable body with a support surface; and an anti-tip device having an anti-tip base and an anti-tip arm, said anti-tip base coupled along or proximate said rotation axis of said inflatable body, wherein said anti-tip arm extending outward of said rotation axis of from only about 1 to 2 inches to shift the distance of a moment-arm backward from the center of mass of said inflatable body, wherein said anti-tip device opposes rotation of said inflatable body about said rotation axis between the points of contact of said inflatable body with said support surface.

2. The inflatable article of claim 1, wherein said bend in said inflatable body defines a back panel and a seat panel of an inflatable chair.

3. The inflatable article of claim 1, wherein said bend in said inflatable body comprises a first bend in said inflatable body defining a back panel and a seat panel, wherein said first bend defines a rotation axis along the points of contact of the inflatable body with a support surface, and comprising a second bend in said inflatable body defining a chaise panel extending from the seat panel to provide an inflatable chaise lounge.

4. An inflatable article, comprising:

an inflatable body having a first face opposite a second face extending to a body periphery, wherein upon inflation said inflatable body has a bend extending to said body periphery, wherein said bend disposed across said second face defines a rotation axis along a plurality of points of contact of the inflatable body with a support surface; and an anti-tip device having an anti-tip base and an anti-tip arm, said anti-tip base coupled along or proximate said rotation axis of said inflatable body, wherein said anti-tip arm extending outward of said rotation axis to shift the distance of a moment-arm backward from the center of mass of said inflatable body, wherein said anti-tip device opposes rotation of said inflatable body about said rotation axis between the points of contact of said inflatable body with said support surface, wherein said anti-tip device consists of an elongate member.

5. The inflatable article of claim 4, wherein said anti-tip device has a cross section orthogonal to the longitudinal axis which generally defines a triangle, wherein a base of said triangle couples to said inflatable body along or proximate said rotation axis, and wherein a first leg of said triangle defines said anti-tip arm extending outward of said rotation axis.

6. A method of making an inflatable chair, comprising:

producing an inflatable body having a first face opposite a second face extending to a body periphery, wherein upon inflation said inflatable body has a bend extending to said body periphery, wherein said bend defines a rotation axis along a plurality of points of contact of the inflatable body and a support surface; and coupling an anti-tip device having an anti-tip base along or proximate said rotation axis of said inflatable body, wherein said anti-tip device has an anti-tip arm extending outward of said rotation axis from only about 1 to 2 inches to shift the distance of a moment-arm backward from the center of mass of said inflatable body, wherein said anti-tip device opposes rotation of said inflatable body about said rotation axis between the points of contact of said inflatable body with said support surface.

7. The method of claim 6, further comprising configuring said anti-tip device to consist of an elongate member.

8. The method of claim 6, wherein said anti-tip device has a cross section orthogonal to the longitudinal axis which generally defines a triangle, wherein a base of said triangle couples to said inflatable body along or proximate said rotation axis, and wherein a first leg of said triangle defines said anti-tip arm extending outward of said rotation axis.

9. The method of claim 6, wherein said bend in said inflatable body defines a back panel and a seat panel of an inflatable chair.

10. The method of claim 6, wherein said bend in said inflatable body comprises a first bend in said inflatable body defining a back panel and a seat panel, wherein said first bend defines a rotation axis along the points of contact of the inflatable body with a support surface, and comprising a second bend in said inflatable body defining a chaise panel extending from the seat panel to provide an inflatable chaise lounge.

* * * * *